United States Patent [19]

Ohashi et al.

[11] Patent Number: 4,971,163

[45] Date of Patent: Nov. 20, 1990

[54] DRILLING BUCKET APPARATUS FOR CAST-IN-PLACE PILES WITH EXPANDED BOTTOMS

[75] Inventors: Akira Ohashi; Takashi Matsuike, both of Osaka, Japan

[73] Assignee: Kabushiki Kaisha Konoike Gumi, Osaka, Japan

[21] Appl. No.: 406,354

[22] Filed: Sep. 12, 1989

[51] Int. Cl.[5] ..... E21B 7/28; E21B 10/32

[52] U.S. Cl. ..... 175/265; 175/267; 175/161

[58] Field of Search ..... 175/263, 265, 266, 267, 175/292, 161; 137/183 A, 18 X

[56] References Cited

U.S. PATENT DOCUMENTS 3,112,802 12/1963 Amann et al. ..... 175/263 X
4,488,606 12/1984 Inoue ..... 175/265 X
4,616,720 10/1986 Kitanaka ..... 175/267

FOREIGN PATENT DOCUMENTS 0005912 1/1985 Japan ..... 175/267
0168814 9/1985 Japan ..... 175/267
0581193 11/1977 U.S.S.R. ..... 175/161

*Primary Examiner*—Stephen J. Novosad
*Attorney, Agent, or Firm*—Wenderoth, Lind & Ponack

[57] ABSTRACT

A drilling bucket apparatus for expanding a bore-hole bottom for a cast-in-place pile. Drill bits are pivotally suspended from the upper portion of a drill pipe, which is a main frame of the apparatus, and are expanded and retracted radially by means of hydraulic cylinders. A bucket is attached to the lower end of the drill pipe and scrapers are installed on the side of the bucket. The scrapers are arranged to open and close sideward, following the movement of the drill bits. During drilling work, the apparatus is suspended from a kelly bar of a drilling machine. When the apparatus is rotated and the drill bits are expanded, the whole expanded shape of a bore-hole bottom is drilled simultaneously and cuttings are scraped into the bucket by means of the drill bits and the scrapers. Further, a bottom lid of the bucket can be released by operating a hydraulically-actuated opening laver, whereby, cuttings are discharged automatically.

4 Claims, 5 Drawing Sheets

DRILLING BUCKET APPARATUS FOR CAST-IN-PLACE PILES WITH EXPANDED BOTTOMS

BACKGROUND OF THE INVENTION

1. Field of the Invention:

This invention relates to new and useful improvements in drilling bucket apparatus for cast-in-place piles with expanded bottoms on construction works.

2. Description of the Prior Art:

In recent construction works, there is an increasing demand for cast-in-place piles with expanded bottoms produced by the use of drilling buckets, to provide economical and reliable piles, which have a larger bearing capacity for the load from the constructed building and with less volume of concrete than straight piles.

In general, an expanded shape of a bore-hole bottom is formed of two portions; an upper portion having a slanting wall, which smoothly enlarges a diameter of the straight hole to a required diameter of the expanded bottom, and a lower portion having a vertical wall, which provides the bearing capacity of expanded piles, in the same manner as straight piles with larger diameter.

SUMMARY OF THE INVENTION

One object of the present invention is to provide an apparatus for expanding a bore-hole bottom for a cast-in-place pile after drilling a straight hole.

An important object of the present invention is to provide an apparatus having hydraulically-actuated drill bits, wherein hydraulic cylinders are directly connected to the drill bits and located horizontally on the center axis of this apparatus, and which radially expand and retract said drill bits somewhat in the manner of an umbrella.

Another object of the present invention is to provide an apparatus having drill bits which are expansible in synchronized motion by means of a linkage, whereby, the whole expanded shape, the slanting wall and the vertical wall, are drilled simultaneously.

A further object of the present invention is to provide an apparatus for scraping cuttings into a bucket by means of scrapers, wherein said scrapers are fitted into the side of the bucket and are opened and closed around vertical hinges following the movement of said drill bits.

BRIEF DESCRIPTION OF THE DRAWINGS

The characteristics and advantages of the invention will be more fully disclosed in connection with the following detailed description of the accompanying drawings, in which.

DETAILED DESCRIPTION OF THE INVENTION

Figure 1:
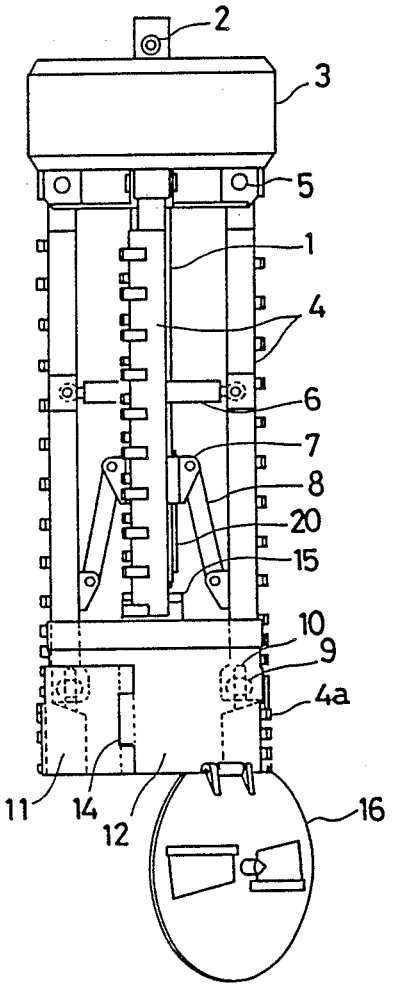
FIG. 1 is a front view of a drilling bucket apparatus, constructed in accordance with the invention, for performing an expanding operation within a bore-hole bottom.
Figure 2:
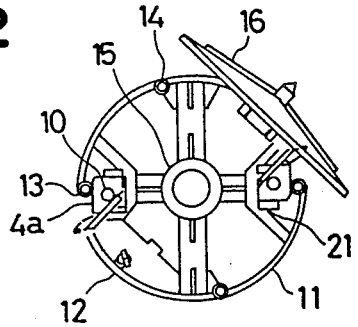
FIG. 2 is a bottom view of the apparatus of FIG. 1.
Figure 3:
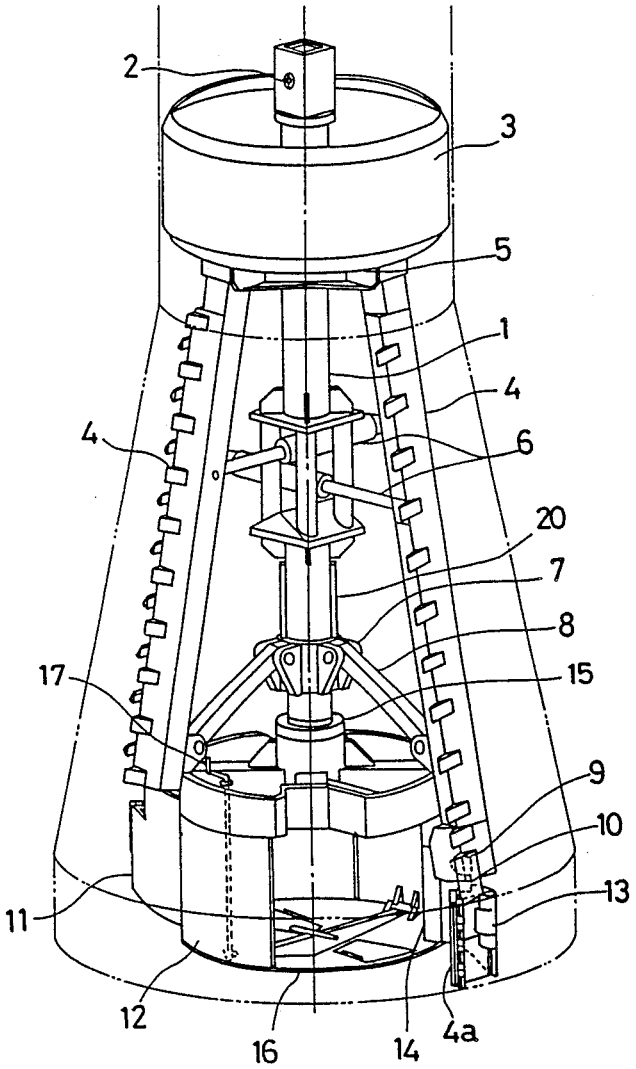
FIG. 3 is an isometrical view illustrating a drilling bucket apparatus in accordance with the invention with the drill bits expanded.

In the drawings, the upper end of a drill pipe 1, which constitutes a main frame of the apparatus, is attached to the kelly bar of a drilling machine by a connecting pin 2, and the apparatus is suspended from the kelly bar so that the torque of the kelly bar is surely transmitted to the apparatus. On the upper portion of the drill pipe 1, a stabilizer 3 is mounted to improve the stability of the apparatus.

Drill bits are provided which are in the form of four wings, and the upper end of each drill bit is attached to the upper portion of the drill pipe 1 by means of a pivot pin 5. A synchronizing ring 7, which slides up and down along the drill pipe 1, is coupled with said drill bits 4 by coupling links 8 and pin joints. A hydraulic cylinder 6 is directly attached to two drill bits which are on diametrically opposite sides of drill pipe 1 from each other. In the case of four wings, two hydraulic cylinders are mounted horizontally so that they overlie each other crosswise in the center of the drill pipe 1. Accordingly, one hydraulic cylinder 6 can apply its driving force to two diametrically opposite drill bits 4, and radially move the drill bits relative to the drill pipe, of which the motions of which are synchronized by the synchronizing ring 7 and the coupling links 8. Here, the movement of the hydraulic cylinders 6 is controlled from the control panel from the ground surface.

Slide keys 20 are installed between the synchronizing ring 7 and the drill pipe 1; therefore, the turning torque of kelly bar is transmitted not only to the drill pipe 1 and the pivot pin 5 but also to the synchronizing ring 7 and the coupling links 8 and thence to the drill bits 4.

Further, a bucket 12 rotatable about drill pipe 1 is connected to the lower end of the drill pipe 1, and scrapers 11 are attached to the side of the bucket by vertical hinges 14.

Figure 4:
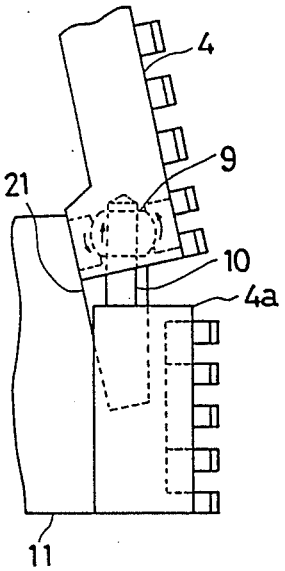
FIG. 4 is a partial vertical view showing the motion of the universal joint of FIG. 3 and illustrating the drill bits in an expanded position.
Figure 5:
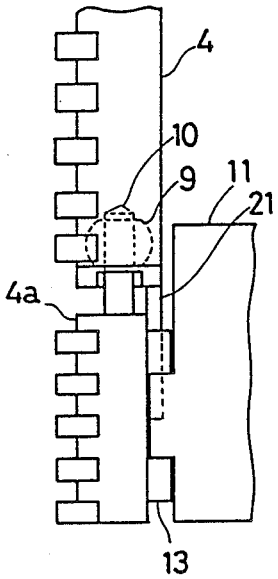
FIG. 5 is a side view of the joint of FIG. 4.

As is shown in FIG. 4 and FIG. 5, each of the drill bits 4 has a lower portion **4*a* connected to a main portion by means of a universal joint. Each universal joint is composed of a spherical bushing 9 and a connecting pin 10. The connecting pin 10 is threaded into the spherical bushing 9 so that the drill bits are pivotable around the universal joint. When the drill bits 4 are opened outwardly by the force of the hydraulic cylinders 6, the connecting pins 10 are moved radially while still hanging vertically. Thereby, the lower portions 4*a*, to which the scrapers 11 are pivotally connected with vertical pins 13**, are moved radially and kept at a vertical position.

Additionally, the lower portion **4*a* of each of the drill bits abuts a guide 21, which depends from the respective drill bits4; therefore this prevents the lower portions 4*a*** of the drill bits from rotating about the connecting pins 10.

Figure 6:
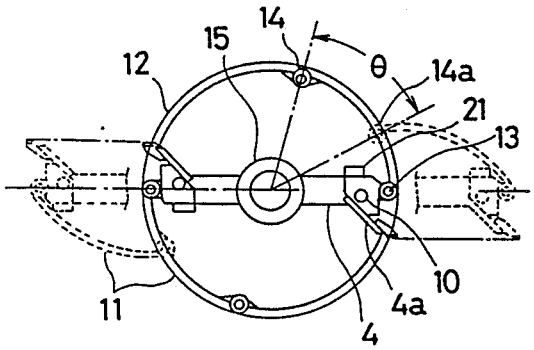
FIG. 6 is a plan view of the bucket which can be turned about the drill pipe following the motion of the drill bits.

FIG. 6 shows the motions of the connecting pins 10, the lower portions 4a of the drill bits, the scrapers 11 and the bucket 12. The bucket 12 is connected to the lower end of the drill pipe 1 by an oscillating shaft 15. When pin shafts 13 and the lower portions 4a of the drill bits are moved radially outwardly, said bucket rotates a required angle $\theta$ on shaft 15 around the drill pipe and displaces each hinge 14 to the position 14a in the direction of drilling rotation, whereby the scrapers 11 are smoothly opened around the hinges 14. On retracting the drill bits, the lower portions 4a of the drill bits and the scrapers 11 are retracted and the bucket 12 rotates in the reverse direction.

The torque from the drill pipe 1 is transmitted to the bucket 12 through the drill bits 4, the spherical bushings 9, the connecting pins 13, the scrapers 11 and the hinges 14.

There are two types, currently in use, of drilling bucket apparatus for cast-in-place pile with expanded bottom. One apparatus has drill bits which are swung about vertical shafts. The other apparatus has separately-expanded drill bits; the upper portions of the drill bits are opened outward by the linkage and the lower portions of the drill bits are opened sideward around vertical hinges.

Figure 9:
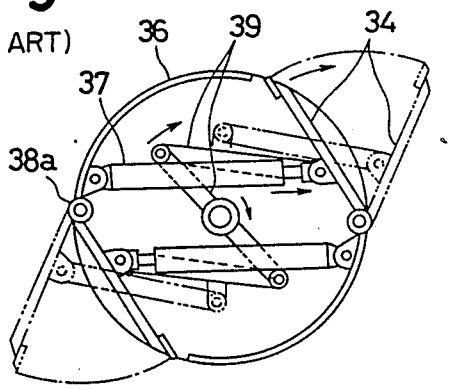
Fig. 9 (PRIOR ART)
FIG. 9 is a plan view of the apparatus of FIG. 8.
Figure 8:
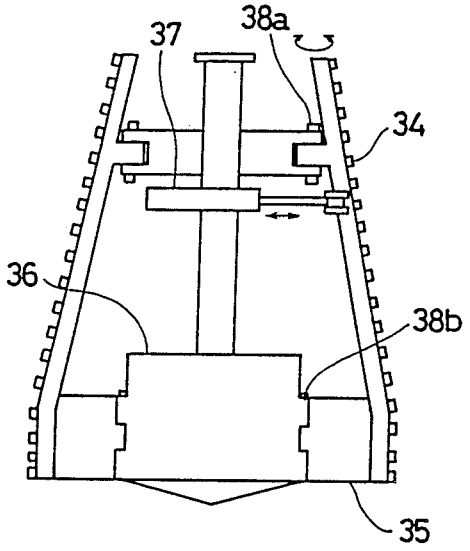
Fig. 8 (PRIOR ART)
FIG. 8 is a side view of a drilling bucket apparatus currently in use, in which the drill bits are swung about vertical shafts.

These apparatuses cause the following problems;

The former, as shown in FIGS. 8 and 9, requires a complicated synchronizing linkage 39, which is mounted horizontally, and the same number of hydraulic cylinders 37 as drill bits 34 in order to expand and retract the drill bits synchronously. Therefore, its penetrating direction and cutting angle against the hole wall vary continuously, when the drill bits expand. Consequently, it is difficult to efficiently drill the upper portion of the slanting wall that is most unstable during the drilling work.

Figure 10:
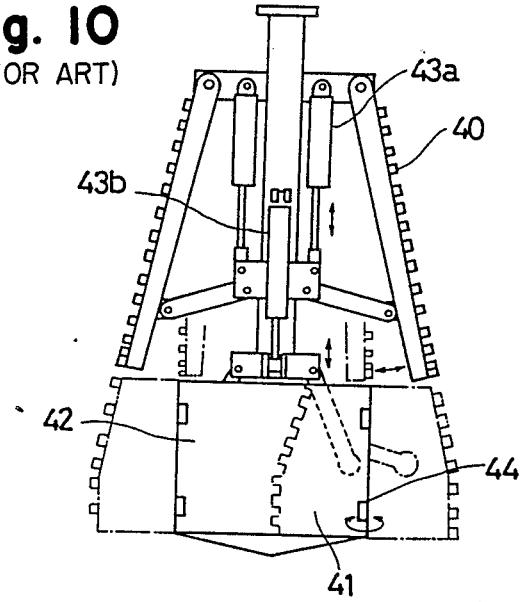
Fig. 10 (PRIOR ART)
FIG. 10 is a side view of another previously used drilling bucket apparatus, in which the upper and the lower portions of the drill bits are expanded separately.

Otherwise, in the latter apparatus as is shown in FIG. 10, the upper and the lower portions of the drill bits are separately expanded by hydraulic cylinders 43a and 43b, and therefore the expanding mechanism is very complicated and it is difficult to drill the whole expanding shape of a hole at one time. Practically, the drilling work with the lower portions of drill bits 41 may be carried out after drilling with the upper portions of drill bits 40. Additionally, the expanding motion of the lower portions of the drill bits 41 must be controlled with a high degree of accuracy to smoothly join the drilling trace of the upper and the lower portions of the drill bits, and its cutting angle and penetration against the hole wall are varied during the expansion of the drill bits. Moreover, because the hydraulic cylinders 43a and 43b are mounted vertically and form a linkage like a toggle joint, the expanding effort on the upper portions of the drill bits is also varied further through the drilling work and the penetration of the drill bits is unstable.

The apparatus of the present invention solves the foregoing problems.

The slanting wall of the expanding shape of a hole is shaped by using the drill bits 4. The drill bits are expanded radially and penetrate the hole wall steadily at a stable cutting angle and with a constant expanding effort. Consequently, the slanting wall of a hole is drilled identically to the opening angle of the drill bits 4. Following the drill bits 4, the lower portions 4a, which are kept at a vertical position, shape the vertical wall of the expanding shape, also at a stable cutting angle and with a constant expanding effort.

After shaping the hole wall corresponding to a full volume of the bucket 12, the drill bits are retracted and cuttings are reliably scraped into the bucket by the lower portions 4a of the drill bits and the front of the scrapers 11. Then the apparatus is surfaced and its bottom lid 16 is opened to discharge cuttings by operating a lever 17 on the bucket 12. This is one cycle of the drilling work and will be repeated until the required diameter of the expanded bottom is completed.

Figure 7:
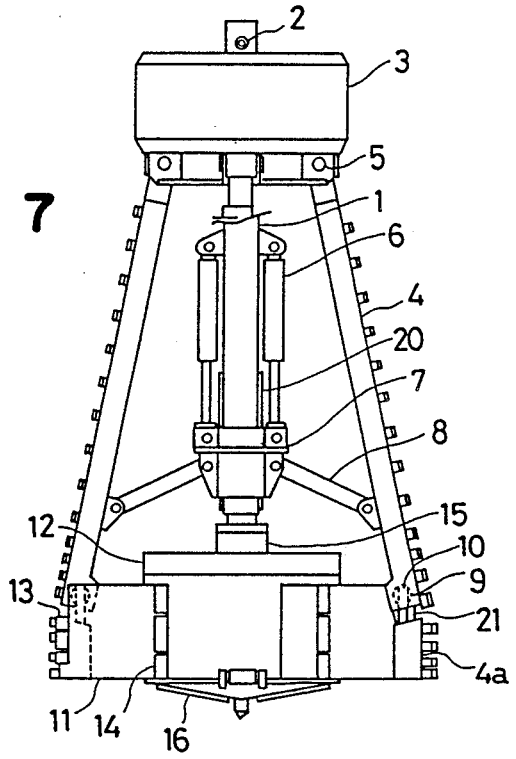
FIG. 7 is a front view of drilling bucket apparatus according another type of the present invention, in which the hydraulic cylinders are mounted vertically.

In the foregoing example of the operation, one arrangement of the apparatus is considered; the drill bits are directly expanded by the hydraulic cylinders which are mounted horizontally. However, employing another arrangement as is shown in FIG. 7, the important objects of the present invention are accomplished completely and all the inconvenient problems of past types of apparatus can be solved, except that the expanding effort for the drill bits 4 varies during the drilling work. In this structure, the synchronizing ring is caused to slide by a pair of hydraulic cylinders 6 mounted vertically, and the drill bits are moved by the linkage.

Furthermore, although the apparatus having four drill bits provides improved stability and is convenient for the quality of piles, the objects of the invention are equally well accomplished with two drill bits.

It is believed that the invention and many attendant advantages will be understood from the foregoing disclosure and description thereof and various changes in size, shape and materials may be made within the scope of the appended claim without departing from the spirit of the invention.

We claim:

1. A drilling bucket apparatus for cast-in-place piles with expanded bottoms, comprising:

a drill pipe mounted in the center of said apparatus and which is attachable to the lower end of a kelly bar of a drilling machine for receiving torque therefrom;

a plurality of drill bits pivotally suspended upon pivot pins from the upper portion of said drill pipe;

a universal joint, which is composed of a spherical bushing and a connecting pin, connected to the lower portion of each drill bit;

a synchronizing ring slidable on said drill pipe and coupling links connected between said ring and said drill bits for forcing said drill bits to open uniformly outwardly in an umbrella type motion when they are urged in an outward direction;

a plurality of hydraulic cylinders coupled to said drill bits for urging said drill bits outwardly;

a bucket rotatably mounted at the lower end of said drill pipe for oscillatory movement about said drill pipe;

a plurality of scrapers pivotally mounted on the side of said bucket on vertical hinges; and a plurality of lower drill bit portions connected to corresponding ones of said universal joints for hanging from said universal joints in a vertical position and connected to said scrapers by a vertical pin connection for interlocking the motion of said scrapers and said drill bits, whereby when said drill pipe is rotated and said hydraulic cylinders are extended, a hole wall is drilled in a shape which corresponds to the form of said drill bits and said lower drill bit portions, and cuttings are scraped into said bucket by said drill bits, lower drill bit portions and said scrapers.

2. A drilling bucket apparatus as claimed in claim 1 in which said hydraulic cylinders are horizontally mounted in said apparatus and are connected directly to said drill bits.

3. A drilling bucket apparatus as claimed in claim 2 in which the drill bits are diametrically oppositely positioned with respect to said drill pipe, and one end of a hydraulic cylinder is connected to one drill bit and the opposite end is connected to a diametrically opposite drill bit for urging both drill bits outwardly when said hydraulic cylinder is expanded.

4. A drilling bucket apparatus as claimed in claim 1 in which said hydraulic cylinders are connected to said synchronizing ring for urging said synchronizing ring along said drill pipe for moving said drill bits outwardly through said coupling links.

* * * * *